US008878044B2

(12) United States Patent
Yanagawa et al.

(10) Patent No.: US 8,878,044 B2
(45) Date of Patent: Nov. 4, 2014

(54) PROCESSING DEVICE AND METHOD FOR DISPLAYING A STATE OF TONE GENERATION APPARATUS

(71) Applicant: Yamaha Corporation, Hamamatsu (JP)

(72) Inventors: Takahiro Yanagawa, Hamamatsu (JP); Shota Kagami, Tokyo (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 13/750,016

(22) Filed: Jan. 25, 2013

(65) Prior Publication Data

US 2013/0192448 A1 Aug. 1, 2013

(30) Foreign Application Priority Data

Jan. 26, 2012 (JP) ..... 2012-014000

(51) Int. Cl.
*G10H 1/00* (2006.01)
*G10H 1/18* (2006.01)
*G10H 7/00* (2006.01)

(52) U.S. Cl.
CPC ..... *G10H 7/00* (2013.01); *G10H 1/0008* (2013.01); *G10H 2220/101* (2013.01)
USPC ..... 84/615

(58) Field of Classification Search
CPC . G10H 1/0008; G10H 1/18; G10H 2220/096; G10H 2220/005; G10H 2220/241; G10H 2220/091
USPC ..... 84/615
See application file for complete search history.

(56) References Cited

U.S. PATENT DOCUMENTS 6,211,452 B1 * 4/2001 Haruyama ..... 84/477 R

FOREIGN PATENT DOCUMENTS

JP 2541063 B2 10/1996

OTHER PUBLICATIONS

Yamaha, Clavinova, Reference Manual CVP-509/505/503/501, with English translation. Cited in spec.

* cited by examiner

*Primary Examiner* — Jeffrey Donels
(74) *Attorney, Agent, or Firm* — Rossi, Kimms & McDowell LLP

(57) ABSTRACT

An electronic musical instrument is capable of generating tones in correspondence with individual ones of a plurality of sound generation parts and allocating desired sound colors and pitch ranges to the individual sound generation parts. A display area for displaying information related to the plurality of sound generation parts is presented on a display device. The individual sound generation parts are set either in a sound generating state or in a non-sound-generating state. The display area is divided in order to set sub display areas corresponding to one or more of the sound generation parts having been set in the sound generating state. The information related to the sound generation parts, having been set in the sound generating state, is displayed in the corresponding sub display areas.

8 Claims, 8 Drawing Sheets

PROCESSING DEVICE AND METHOD FOR DISPLAYING A STATE OF TONE GENERATION APPARATUS

BACKGROUND

The present invention relates to a processing device and method for displaying a state of a tone generation apparatus, such as an electronic musical instrument or a tone or sound generator apparatus.

In the field of musical instruments, such as electric pianos and keyboards, there has been known a function called "dual" or "layer" for causing a plurality of timbres or sound colors (voices) to sound simultaneously in an overlapping fashion. When such a layer function is ON, a sound color of a main part and a sound color of a layer part are sounded simultaneously. Also known is a function for dividing a key range into left- and right-side key ranges to cause different sound colors to sound separately in the left- and right-side key ranges. According to the split function, a predetermined position is set as a split point, and a pitch (sound pitch) range higher than the split point is set as a right part (right-side key range) while a pitch range lower than the split point is set as a left part (left-side key range). If the right part is performed when the split function is ON, a tone of a sound color set for the right part is generated, while, if the left part is performed when the split function is ON, a tone of a sound color set for the left part is generated.

Further, in some of the conventionally-known electronic musical instruments having both the layer function and the split function, when the right part is performed with the split function ON and with the layer function turned on for the right part, tones having a sound color of the main part and a sound color of the layer part can be sounded simultaneously. In such electronic musical instruments, ON/OFF states of individual parts (e.g., main, layer and left parts), sound colors set for the individual parts and the like are displayed on a display screen, LEDs, etc. provided on a main panel of the body of the electronic musical instrument, so that various settings can be checked or ascertained even when no performance is actually executed (i.e., even when no sounds are actually generated). (See, for example, "Clavinova CVP-509/505/503/501 Instruction Manual", Yamaha Corporation, available online from the Internet at <URL: http://www2.yamaha.co.jp/manual/pdf/emi/japan/cla/cvp509_ja_cm_d0.pdf>.

Further, in the electronic musical instruments, a user or human player may sometimes change and/or check settings in the middle of a performance, and thus, it is desired that the human player be capable of intuitively checking or ascertaining current settings. However, with the conventionally-known electronic musical instruments, settings of the individual parts are displayed together in a list, and thus, individual pieces of information tend to be small in size and thus difficult to read. Further, because pieces of information of all of the parts are always displayed on the display screen regardless of ON/OFF states of the individual parts, it is sometimes difficult to instantaneously see which sound colors will be sounded with the current settings. Furthermore, because there is no association between displayed positions on the display screen and actual generating positions of sounds (key ranges), it is difficult to intuitively grasp, from the display on the display screen, which sound colors will be sounded on which key ranges of a keyboard.

SUMMARY OF THE INVENTION

In view of the foregoing prior art problems, it is an object of the present invention to provide an improved processing device and method for displaying a setting state in a tone generation apparatus, such as an electronic musical instrument or tone or sound generator apparatus, in such a manner as to allow a user to readily recognize the setting state or in an easy-to-recognize manner.

In order to accomplish the above-mentioned object, the present invention provides an improved processing device for displaying a state of a tone generation apparatus, the tone generation apparatus being configured to be capable of generating tones in correspondence with individual ones of a plurality of sound generation parts and allocating desired sound colors and pitch ranges to the individual sound generation parts, the processing device comprising: a first display control section adapted to present, on a display device, a display area for displaying information related to the plurality of sound generation parts; a selection section adapted to selectively set individual ones of the sound generation parts either in a sound generating state or in a non-sound-generating state; a division control section adapted to divide the display area in order to set sub display areas corresponding to one or more of the sound generation parts having been set in the sound generating state by the selection section; and a second display control section adapted to display the information related to the sound generation parts, having been set in the sound generating state, in corresponding ones of the sub display areas set by the division control section dividing the display area.

According to the present invention, the display area is divided to set sub display areas corresponding to one or more sound generation parts having been set in the sound generating state, and the information related to the sound generation parts having been set in the sound generating state are displayed in the corresponding sub display areas. Thus, the display area can be used effectively for only one or more sound generation parts having set in the sound generating state and can display settings in such a manner as to allow a user to readily recognize the settings, i.e. can display the settings in an easy-to-recognize fashion.

The present invention may be constructed and implemented not only as the apparatus invention discussed above but also as a method invention. Also, the present invention may be arranged and implemented as a software program for execution by a processor, such as a computer or DSP, as well as a non-transitory storage medium storing such a software program. In this case, the program may be provided to a user in the storage medium and then installed into a computer of the user, or delivered from a server apparatus to a computer of a client via a communication network and then installed into the client's computer. Further, the processor used in the present invention may comprise a dedicated processor with dedicated logic built in hardware, not to mention a computer or other general-purpose processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Figure 1:
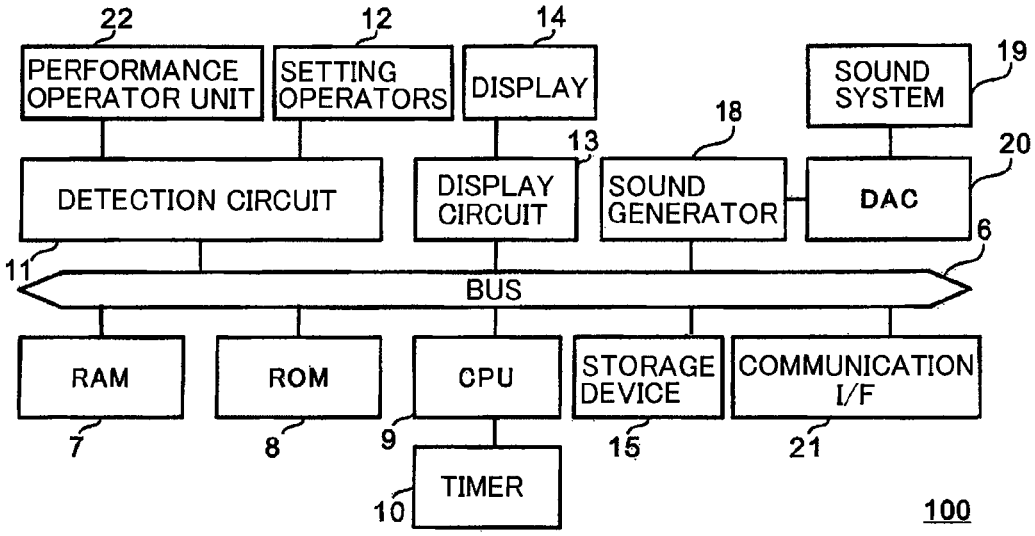
FIG. 1 is a schematic diagram showing an example hardware construction of an electronic musical instrument according to a preferred embodiment of the present invention.

FIG. 1 is a schematic diagram showing an example hardware construction of an electronic musical instrument 100 according to a preferred embodiment of the present invention. To a bus 6 of the electronic musical instrument 100 are connected a RAM 7, a ROM 8, a CPU 9, a detection circuit 11, a display circuit 13, a storage device 15, a tone or sound generator circuit 18 and a communication interface (I/F) 21. The RAM 7 includes buffer regions, such as for a reproduction (play) buffer, flags, registers, and a working area to be used by the CPU 9 for storing various parameters etc. In the ROM 8 can be stored, among other things, various data files, various parameters and control programs, and programs for implementing the instant embodiment. In this case, the programs etc. need not be stored in the storage device 15 if they are stored in the ROM 8. The CPU 9 performs arithmetic operations and control of the electronic musical instrument 100 in accordance with the control programs or the programs for implementing the instant embodiment which are stored in the ROM 8 or storage device 15. A timer 10 is connected to the CPU 9, so that fundamental clock signals, interrupt processing timing, etc. are supplied to the CPU 9.

A user or human operator can make various entries, settings and selections by use of setting operators 12 connected to the detection circuit 11. The setting operators 12 may be of any desired types, such as switch, pad, fader, slider, rotary encoder, joy stick, jog shuttle, character/letter entering keyboard and mouse types, as long as they can output signals corresponding to user's entries. The setting operators 12 may also be software switches displayed on a display device 14 operable using another operator, such as a cursor switch.

A touch panel is an operator for detecting user's depressing or touching operation on a touch-operating panel surface provided on the surface of the display device 14 and outputting position information (e.g., XY coordinates) of a user-operated position on the panel surface. In the instant embodiment, such a touch panel is used as the setting operator 12, and position information output from the touch panel is associated with a command to be executed by the electronic musical instrument 100. The association between the position information and the command changes in accordance with information displayed on the display device 14. Note that, in the instant embodiment, a combination of the touch operating surface and display screen of the display device 14 is collectively referred to as the touch panel (setting operator 12).

The display circuit 13 is connected to the display device 14 to display various information on the display device 14. The display device 14 can display, among other things, various information for setting the electronic musical instrument 100. In the instant embodiment, the display device 14 displays, for example, a home screen shown in FIG. 2.

The storage device 15 comprises at least one of combinations of storage media, such as a hard disk, FD (Flexible Disk or Floppy Disk (registered trademark)), CD (Compact Disk), DVD (Digital Versatile Disk) and semiconductor like a flash memory, and drive devices for driving the storage media. Such storage media may be either detachably attached to or built in the corresponding drive device. The storage device 15 and/or ROM 8 preferably stores a plurality of automatic performance data sets (song data sets) and automatic accompaniment data sets (accompaniment style data sets), but also stores programs for implementing various embodiments of the present invention and other control programs. In the case where the programs for implementing various embodiments of the present invention and other control programs are stored in the storage device 15, there is no need to store the same programs in the ROM 8. Alternatively, only some of the programs may be stored in the storage device 15 with the other programs stored in the ROM 8.

The sound generator circuit 18 generates tone signals in accordance with automatic accompaniment data and automatic performance data recorded in the storage device 15, ROM 8 or RAM 7, or performance signals, MIDI signals, phrase waveform data, etc. supplied from a performance operator unit (e.g., keyboard) 22, external equipment connected to the communication interface 21, or the like. Then, after imparting various musical effects to the generated tone signals, the sound generator circuit 18 supplies the tone signals to a sound system 19 via a DAC 20. The DAC 20 converts each of the supplied digital tone signals into analog representation, and the sound system 19 includes an amplifier and a speaker to audibly generate the DA-converted tone signal.

The communication interface 21 comprises at least one of a general-purpose short-distance wired I/F like a USB or IEEE1394, a general-purpose network I/F like Ethernet (registered trademark), a general-purpose I/F like a MIDI I/F, a general-purpose short-distance wireless interface like a wireless LAN or Bluetooth (registered trademark), and a communication interface dedicated to music. The communication interface 21 is capable of communicating with external equipment, server, etc.

The performance operator unit (e.g., keyboard) 22 is connected to the detection circuit 11 and supplies performance information (performance data) in accordance with user's performance operation. The performance operator unit 22, which is operable to enter a user's performance, inputs start timing and end timing of each user's operation of the performance operator unit 22 as key-on and key-off signals with a sound pitch corresponding to an operator operated by the user. Further, the performance operator unit 22 is capable of inputting various parameters, such as velocity values, in response to the user's performance operation.

Note that, if the electronic musical instrument 100 is a music apparatus or the like other than a musical instrument, then the performance operator unit 22 may be dispensed with. In such a case, an external performance operator unit may be connected to the communication interface 21 so that the function of the aforementioned performance operator unit 22 is performed by the external performance operator unit. Also, an external display may be connected to the communication interface 21 to replace the aforementioned display device 14. Namely, the hardware of the display device 14 may be physically independent of the electronic musical instrument 100. Further, as necessary, any one or more of the afore-mentioned components may be dispensed with, and other components may be added to the electronic musical instrument 100.

In the instant embodiment, a processing device for displaying one or more states of a tone generation apparatus is constructed of the CPU 9 and the RAM 7, ROM 8 and storage device 15 related to the CPU 9, the display device 14 and the display circuit 13 related to the display device 14, the setting operators 12, etc. which are incorporated in the electronic musical instrument 100. Note, however, the processing device need not necessarily be incorporated in the electronic musical instrument (or tone generation apparatus) 100. Thus, the processing device can be constructed without the performance operator unit 22, sound generator circuit 18, DAC 20 and sound system 19 shown in FIG. 1. In such a case, the processing device operates in cooperation with the operators and/or sound generator circuit provided in or on the electronic musical instrument (or tone generation apparatus) 100. Alternatively, all of the component parts of the processing device may be physically incorporated in the electronic musical instrument (or tone generation apparatus) 100, or some of the component parts of the processing device may be physically incorporated in the electronic musical instrument (or tone generation apparatus) 100 with the remainder of the component parts of the processing device provided outside the electronic musical instrument (or tone generation apparatus) 100. Of course, in the case where all or some of the component parts of the processing device are provided outside the electronic musical instrument (or tone generation apparatus) 100, at least a section including the display device 14 and setting operators 12 may be provided and used near the electronic musical instrument (or tone generation apparatus) 100 to which the processing device is applied. Note that, in the embodiment disclosed here, the entire electronic musical instrument 100 or a section of the electronic musical instrument 100 including at least the sound generator circuit 18 and the CPU 9 etc. implementing tone generation processing related to the sound generator circuit 18 functions as a tone generation apparatus constructed to be capable of generating tones in correspondence with a plurality of sound generation parts.

Figure 2:
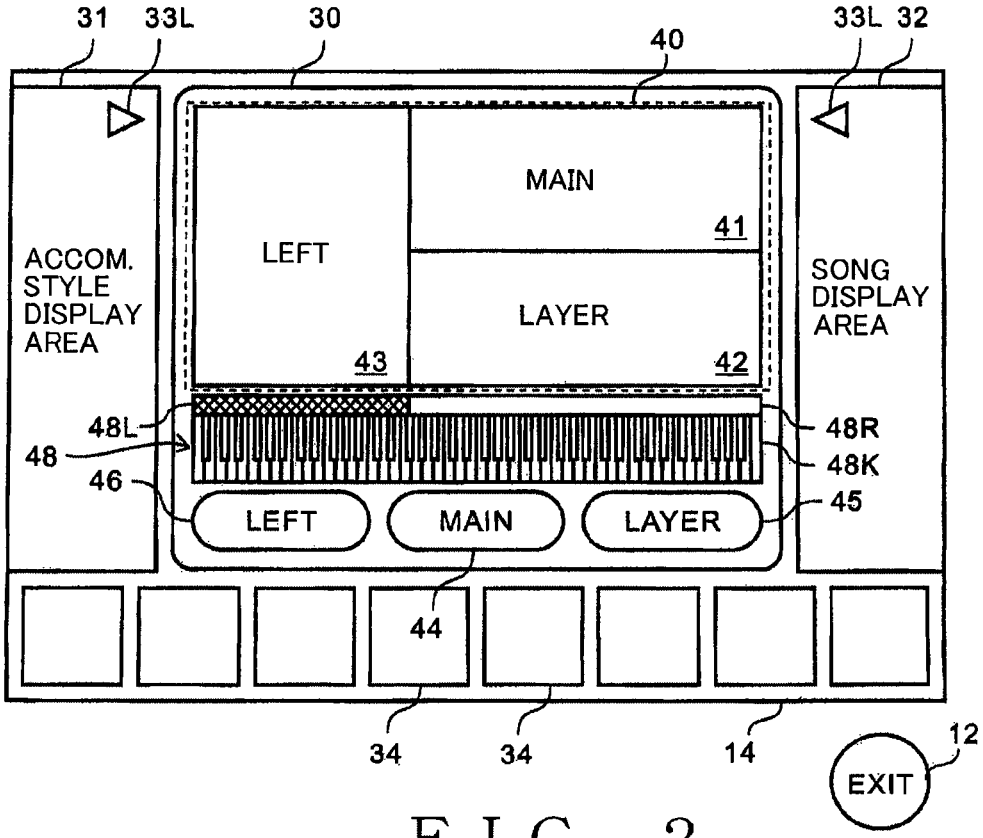
FIG. 2 is a plan view showing an example home screen displayed on a display of FIG. 1.

FIG. 2 is a plan view showing an example home screen displayed on the display device 14 of FIG. 1. Upon powering-on of the electronic musical instrument 100, the CPU 9 starts executing a software application for implementing the processing device of the invention, so that the home screen shown in FIG. 2 is displayed on the display device 14 of FIG. 1.

For example, in an initial state following the powering-on of the electronic musical instrument 100, a sound color (timbre) display area 30 is displayed centrally in the home screen, an accompaniment style display area 31 is displayed to the left of the sound color display area 30, and a song display area 32 is displayed to the right of the sound color display area 30. In a lower portion of the screen are displayed menu icons 34 for performing various functions (such as musical score display, lyrics display, transpose setting and mixer functions). Once the user touches any one of the menu icons 34, a screen (e.g., setting screen) related to the function associated with the user-touched menu icon 34 is displayed on the entire display surface of the display device 14. Once the user pushes an Exit button 12 provided outside the screen of the display device 14, the function-related screen is closed, and the display device 14 returns to the home screen shown in FIG. 2.

In the sound color display area 30 are displayed a sound color name display section 40, sounding key range display section 48 (48K, 48L and 48R), part-specific ON/OFF switching switches (i.e., main-part ON/OFF button 44, layer-part ON/OFF button 45 and left-part ON/OFF button 46). These part ON/OFF buttons 44, 45 and 46 each function as a selection section adapted to selectively set a corresponding one of the sound generation parts in a sound generating state or a non-sound-generating state. In the instant embodiment, each of such selection sections selectively sets the corresponding sound generation part in the sound generating state or the non-sound-generating state in response to user's operation. Alternatively, each of the sound generation parts may be selectively set in the sound generating state or the non-sound-generating state in accordance with automatic performance data.

In the instant embodiment of the electronic musical instrument 100, there are provided the main part (i.e., first sound generation part in a layer mode), layer part (i.e., second sound generation part in the layer mode) and left part (i.e., sound generation part corresponding to a left-side key range in a split mode), and these sound generation parts can be selectively placed in an ON state (sound generating state) or in an OFF state (non-sound-generating state) independently of one another.

For each of the above-mentioned sound generation parts, a desired sound color (timbre) and a desired pitch range are designated (allocated) in accordance with at least a parameter designating a sound color and a parameter designating a sounding key range (pitch range) where a sound is generated with the designated sound color. For example, once the user plays a particular pitch range of the performance operator unit 22 of FIG. 1, a tone or sound is generated by the sound generator circuit 18 (FIG. 1) using a sound color of the sound generation part allocated to the particular pitch range. Alternatively, a tone or sound based on automatic performance data is generated by the sound generator circuit 18 in accordance with sound color and pitch range allocation information of each sound generation part included in the automatic performance data. Note that the main part and the layer part are sounded in the entire key range when the left part is OFF, but sounded in the right-side key range higher in pitch than a split point when the left part is ON (i.e., in the split mode).

In the sound color name display section 40 is displayed information of each of the sound generation parts, such as a sound color name, image of a musical instrument corresponding to the sound color and a text explanatory of the sound color. Once the user touches a sound color display area 41, 42 or 43 of any one of the sound generation parts, a setting screen, such as a screen for selecting a sound color for that sound generation part, is displayed so that the user can change a sound color etc. The sound color name display section 40 is a display area for displaying information related to the plurality of sound generation parts. The part-specific sound color display areas 41, 42 and 43 set by dividing the sound color name display section 40 are sub display areas corresponding to the sound generation parts. The CPU 9, display circuit 13, etc. cooperating to display the sound color name display section 40 on the display device 14 function as a first display control section adapted to display information related to the plurality of sound generation parts.

The sound color name display section 40 is divided in accordance with the number of the sound generation parts currently in the ON state (sound generating state), so that it is readily visually check which of the sound generation parts is currently in the ON state. For example, when all of the sound generation parts are in the ON state, a right-side region of the sound color display area 30 is divided vertically (in an up-down direction) in such a manner that the main display area (sub display area for a main sound color part) 41 for displaying information of a main sound color in the layer mode is positioned or displayed in the divided upper-side region while the layer display area (sub display area for a layer sound color part) 42 for displaying information of a layer sound color is displayed in the divided lower-side region. Further, a left display area (sub display area for a left sound color part) 43 for displaying a sound color of a left-side key range (left sound color) in the split mode is displayed. Note that the screen division of the sound color display area 30 will be described later in greater detail with reference to FIGS. 4A to 4E.

The sounding key range display section 48 includes a keyboard image 48K, a left-side key range display portion 48L and a right-side key range display portion 48R. In this specification, the keyboard image 48K, left-side key range display portion 48L and right-side key range display portion 48R are collectively referred to as "sounding key range display section 48". In the sounding key range display section 48, the keyboard image 48K is displayed below the sound color display section 40 and has the same number of keys as the electronic musical instrument 100, the left-side key range display portion 48L indicative of the left-side key range of the keyboard is displayed as a shaded horizontal bar above the keyboard image 48K, and the right-side key range display portion 48R indicative of the right-side key range of the keyboard is displayed to the right of the left-side key range display portion 48L. A boundary between the left-side key range display portion 48L and the right-side key range display portion 48R is the split point.

The sound color display section 40 is divided horizontally (i.e., in a left-right direction) so that the split point is approximately identifiable when the left part is ON, but the sounding key ranges and the split point are displayed more specifically by the sounding key range display section 48.

Once the user touches the sounding key range display section 48, a screen for setting sounding key ranges (and hence a split point) is opened, so that the user is allowed to set the sounding key ranges (split point). Alternatively, the user may touch a position of the keyboard image 48K to set the touched position as the split point, or the user may operate the performance operator unit 22 (FIG. 1) while touching a position of the keyboard image 48K to set the touched position as the split point.

Each of the part ON/OFF buttons (main part ON/OFF button 44, layer part ON/OFF button 45 and left part ON/OFF button 46) is a software switch for switching between the ON and OFF states of the corresponding sound generation part. Switching between the ON and OFF states of the corresponding sound generation part is effected in an alternate fashion in response to the user touching the part ON/OFF button 44, 45 or 46. Note that the part ON/OFF buttons (main part ON/OFF button 44, layer part ON/OFF button 45 and left part ON/OFF button 46) may be provided as physical buttons on a main operation panel rather than as software switches provided on the touch panel surface.

In the initial state shown in FIG. 2, basic information, operation buttons etc., such as a currently-set accompaniment style name, chord name and play/stop button, are displayed in the accompaniment style display area 31. Further, an enlarge button 33L for enlarging a displayed size of the accompaniment style display area 31 is displayed in the accompaniment style display area 31.

In the instant embodiment, the sub display areas 41, 42 and 43 of the individual sound generation parts are displayed by default in predetermined positions and in predetermined sizes corresponding to respective default allocated states and sound generating/non-sound-generating states of the sound generation parts. Namely, in this instance, all of the sound generation parts are set in the sound generating state (ON state) by default. Of course, because the default sound generating/non-sound-generating states (ON/OFF states) of the individual sound generation parts can be defined as desired, a display style of the home screen may differ from that of FIG. 2 in accordance with the definition of the sound generating/non-sound-generating states (ON/OFF states) of the individual sound generation parts.

Figure 3A:
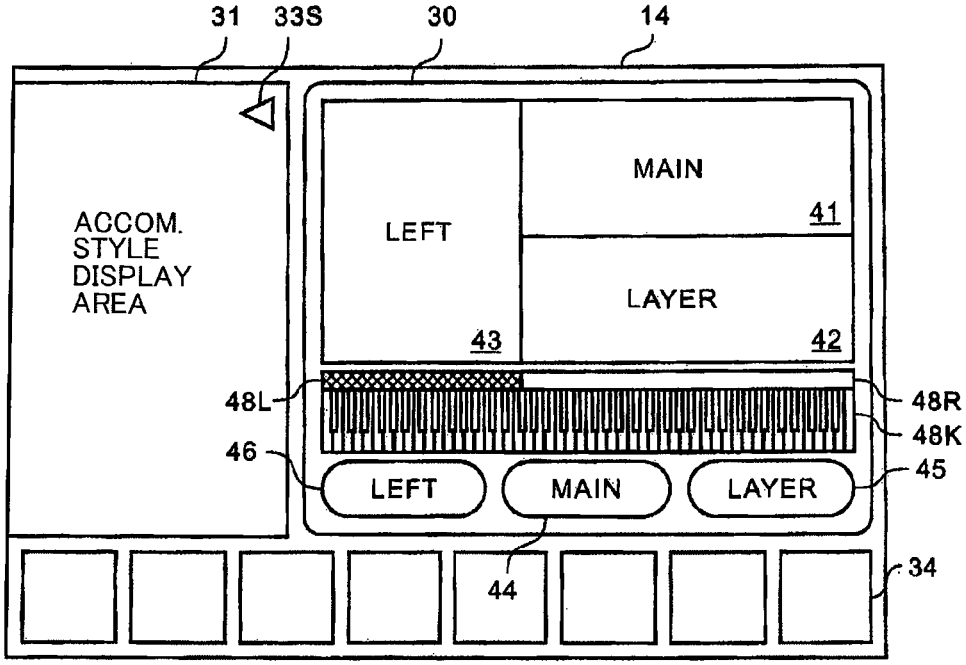
FIGS. 3A and 3B are diagrams showing examples of screen division of a home screen shown in FIG. 2.

Once the user touches the enlarge button 33L in the accompaniment style display area 31, the displayed size of the accompaniment style display area 31 is enlarged toward the center of the screen as shown in FIG. 3A, at which time the song display area 32 is placed in a non-displayed state and a displayed position of the sound color display area 30 moved rightward. Note, however, that the displayed size of the sound color display area 30 does not change.

As the accompaniment style display area 31 is enlarged as above, a plurality of buttons for performing further detailed setting and operation, such as buttons for switching among various sections (such as intro, fill-in and ending sections) of an accompaniment style, are displayed in addition to the information displayed in a non-enlarged state (i.e., state of FIG. 2) of the accompaniment style display area 31. Further, in the enlarged state, a contract button 33S for reducing the displayed size of the accompaniment style display area 31 (i.e., for returning the accompaniment style display area 31 back to its original size) is displayed so that the screen returns to the state of FIG. 2 in response to the user touching the contract button 33S.

The accompaniment style display area 31 of FIG. 3A may be automatically enlarged in response to the user depressing a style button that is a physical button provided on the panel of the body of the electronic musical instrument or in response to reproduction of an accompaniment style, rather than in response to the user touching the enlarge button 33L.

Figure 3B:
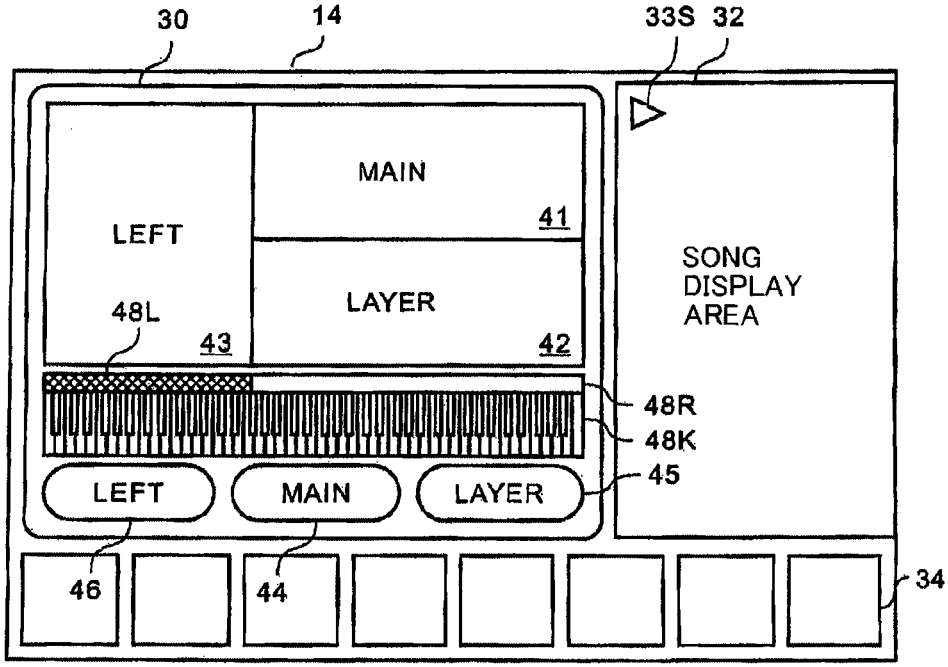

In the initial state shown in FIG. 2, basic information, operation buttons etc., such as a current song's name, reproduced position, recording button and reproduction (play)/stop button, is displayed in the song display area 32. Further, an enlarge button 33L for enlarging a displayed size of the song display area 32 is displayed in the song display area 32. Once the user touches the enlarge button 33L in the song display area 32, the displayed size of the song display area 32 is enlarged toward the center of the screen as shown in FIG. 3B, at which time the accompaniment style display area 31 is placed in a non-displayed state and the displayed position of the sound color display area 30 moved leftward. Note, however, that the displayed size of the sound color display area 30 does not change.

As the song display area 32 is enlarged as above, a plurality of buttons for performing further detailed setting and operation, such as a guide function ON/OFF button, guide part selection button, fast-forwarding and fast-rewinding buttons and repeat setting button, are displayed in addition to the information displayed in a non-enlarged state (i.e., state of FIG. 2) of the song display area 32. Further, in the enlarged state, a contract button 33S for reducing the displayed size of the song display area 32 (i.e., for returning the song display area 32 back to its original size) is displayed so that the screen returns to the state of FIG. 2 in response to the user touching the contract button 33S. The song display area 32 of FIG. 3B may be automatically enlarged in response to the user depressing a song button that is a physical button provided on the panel of the body of the electronic musical instrument or in response to reproduction of a song, rather than in response to the user touching the enlarge button 33L.

While the sound color display area 30 is displayed centrally in the screen as shown in FIG. 2, the displayed size of the sound color display area 30 is not changed either when the displayed size of the accompaniment style display area 31 has been enlarged as shown in FIG. 3A or when the displayed size of the song display area 32 has been enlarged as shown in FIG. 3B. Thus, visibility of information displayed in the sound color display area 30 does not change depending on the state of the home screen, and thus, it is possible to check or ascertain settings of each of the sound generation parts always under the same conditions.

Figure 4A:
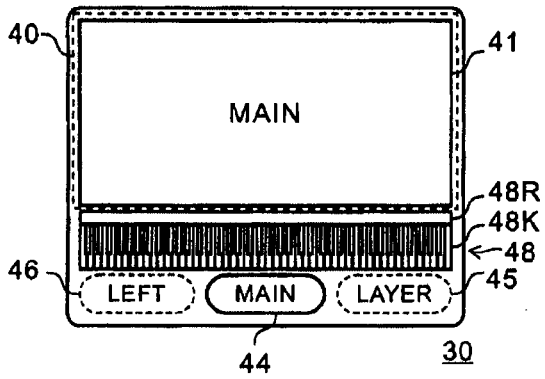
FIGS. 4A to 4E are diagrams showing several examples of screen division of a sound color name display section.

FIGS. 4A to 4E are diagrams showing several example manners in which the sound color display area 30 is divided (i.e., examples of the screen division). In these figures, the ON/OFF buttons in the ON state are indicated by solid line, while the ON/OFF buttons in the OFF state are indicated by broken line. More specifically, FIG. 4A shows an example of the screen division where only the main part is in the ON state (sound generating state). In this case, because only the main part is in the ON state, only the main part ON/OFF button 44 is displayed in a display style (solid line) indicating the ON state, while the layer part ON/OFF button 45 and the left part ON/OFF button 46 are displayed in a display style (broken line) indicating the OFF state.

In the case where the main part is in the ON (sound generating) state with the left and layer parts in the OFF (non-sound-generating) state as shown in FIG. 4A, the main display area 41 is displayed in the entire sound color name display section 40 without the left and layer display areas being displayed. Further, because no horizontal division (or left-right screen division) is made, the right-side key range display portion 48R is displayed in the sounding key range display section 48 without the left-side key range display portion 48L being displayed in the sounding key range display section 48. Thus, the user can readily recognize that only the sound color of the main part is sounded in the entire key range.

Figure 4B:
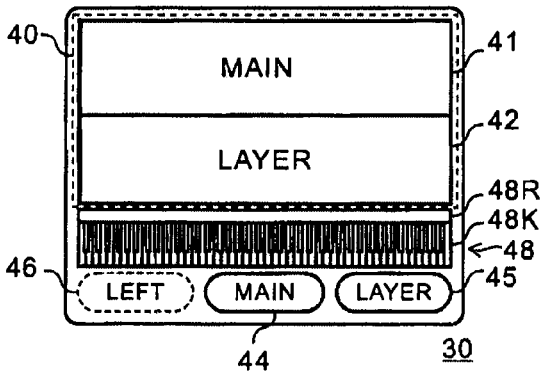
Figure 4C:
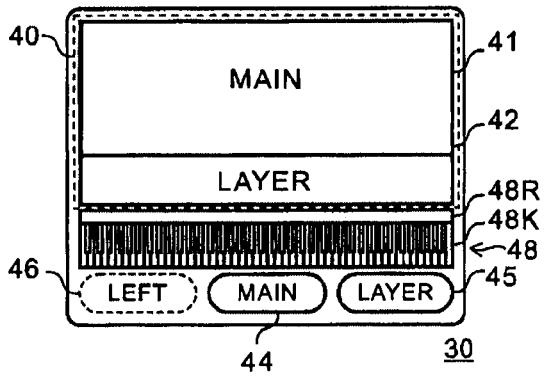

FIGS. 4B and 4C show examples of the screen division where the main part and the layer part are in the ON state (sound generating state) with the left part in the OFF state (non-sound-generating state). In this case, because the main part and the layer part are in the ON state with the left part in the OFF state, the main part ON/OFF button 44 and the layer part ON/OFF button 45 are displayed in the display style (solid line) indicating the ON state, while the left part ON/OFF button 46 is displayed in the display style (broken line) indicating the OFF state.

Further, because the left part is in the OFF state (i.e., the split mode is OFF) in the examples of FIGS. 4B and 4C, only vertical (or up-down) screen division is made with no horizontal (or left-right) screen division made. The main display area 41 is displayed in the upper-side region of the vertically-divided sound color name display section 40, and the layer display area 42 is displayed in the lower-side region of the vertically-divided sound color name display section 40. A boundary line of the vertical (or up-down) screen division may be set on the basis of sound volume balance between the main part and the layer part in such a manner that one of the main and layer parts having a greater sound volume than the other is displayed in a larger size while the other of the main and layer parts having a smaller sound volume is displayed in a smaller size. FIG. 4B shows an example where the main part and the layer part have generally equal sounds, and FIG. 4C shows an example where the sound of the main part has a greater volume than that of the layer part.

Furthermore, because no horizontal screen division is made in the examples of FIGS. 4B and 4C, the right-side key range display portion 48R is displayed in the entire sounding key range display section 48 without the left-side key range display portion 48L being displayed in the sounding key range display section 48. Thus, the user can readily recognize that the sound colors of the main and layer parts are sounded simultaneously in the entire key range. Further, because a position of the boundary line of the vertical division is set on the basis of the sound volume balance between the main part and the layer part, the user can also readily recognize the sound volume balance between the main part and the layer part.

Figure 4D:
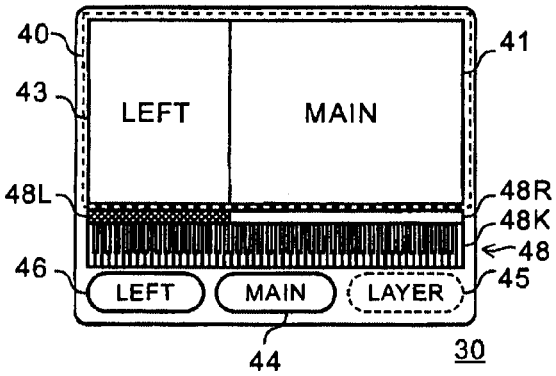

FIG. 4D shows another example of the screen division where the main part and the left part are in the ON state (sound generating state) with the layer part in the OFF state (non-sound-generating state). In this case, because the main part and the left part are in the ON state with the layer part in the OFF state, the main part ON/OFF button 44 and the left part ON/OFF button 46 are displayed in the display style (solid line) indicating the ON state, while the layer part ON/OFF button 45 is displayed in the display style (broken line) indicating the OFF state. Further, because the layer part is OFF, only horizontal screen division is made with no vertical screen division made. The main display area 41 is displayed in the right-side region of the horizontally-divided sound color name display section 40, and the left display area 43 is displayed in the left-side region of the horizontally-divided sound color name display section 40. A boundary line of the horizontal screen division is set on the basis of the split point as described later.

The left-side key range display portion 48L displayed immediately above the keyboard image 48K extends from the left end (corresponding to the lowest pitch) of the keyboard image 48K to the split point to indicate a key range of the left part. Also, the horizontally-divided position of the sound color name display section 40 is set such that a horizontal width of the left-side region of the sound color name display section 40 is set to be the same as a horizontal width of the left-side key range display portion 48L.

Figure 4E:
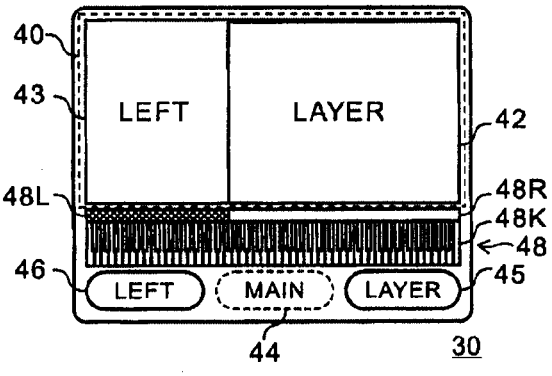

FIG. 4E shows still another example of the screen division where the layer part and left part are in the ON state (sound generating state) with the main part in the OFF state (non-sound-generating state). In this case, because the layer part and left part are ON with the main part OFF, the layer part ON/OFF button 45 and the left part ON/OFF button 46 are displayed in the display style (solid line) indicating the ON state, and the main part ON/OFF button 44 is displayed in the display style (broken line) indicating the OFF state. Because the main part is OFF, only horizontal (left-right) screen division is made with no vertical screen division made. The layer display area 42 is displayed in the right-side region of the horizontally-divided sound color name display section 40, and the left display area 43 is displayed in the left-side region of the horizontally-divided sound color name display section 40. In this example, a boundary line of the horizontal screen division is set on the basis of the split point as in the example shown in FIG. 4D.

Note that, if only the layer part is in the ON state, the layer area 42 is displayed in the entire sound color name display section 40 as in the example of FIG. 4A where only the main part is in the ON state.

Further, the left part is always displayed only in the left-side key range, and thus, when only the left part is in the ON state too, the left part is displayed in the left-side region in conformity with the split point. Namely, the left part is displayed in a screen division style similar to that in the initial state of FIG. 2 where all of the parts are in the ON state or that of FIG. 4D where the main part and the left part are in the ON state. Note that, in this example, an indication, such as "No Voice", indicative of the non-sound-generating state is displayed for the main part 41 (and layer part 42).

By dividing the screen as set forth above, the instant embodiment allows the user to visually recognize not only each sound generation part currently in the ON state but also relationship among the sound generation parts (i.e., whether these sound generation parts are sounded simultaneously, sounded in a left-right divided manner, or the like).

Figure 5A:
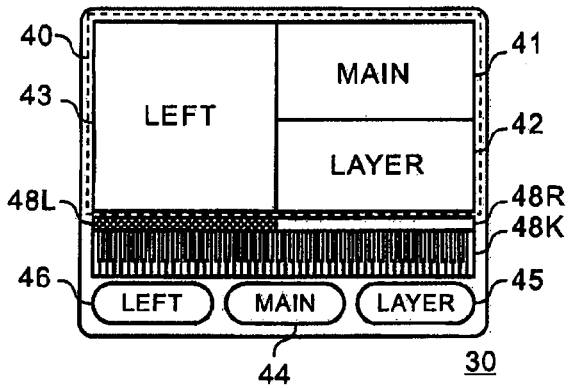
FIGS. 5A to 5C are plan views explanatory of interlocking between a split point and a horizontally-divided position of a sound color name display section.
Figure 5B:
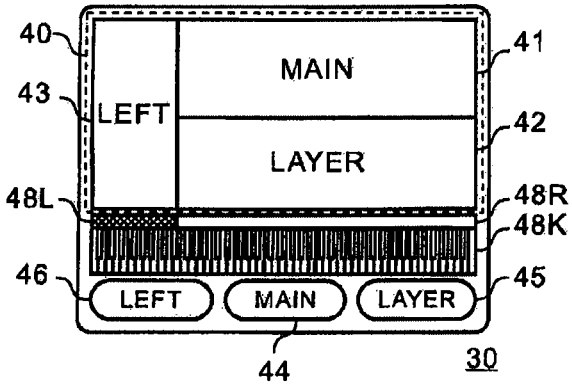

When the left part is in the ON state, as shown in FIGS. 5A and 5B, a horizontally-divided (i.e., left-right-divided) position of the sound color name display section 40 is determined in conformity with (or in interlocked relation to) the split point. Namely, the left part to be sounded in the left-side key range is displayed in the left-side region of the screen, while the parts (main part and layer part) to be sounded in the right-side key range are displayed in the right-side region of the screen. For example, where the split point is set near a horizontally-middle position of the key range as shown in FIG. 5A, the horizontally-divided (i.e., left-right-divided) position of the sound color name display section 40 is set near the horizontally-middle position of the key range in conformity with the position of the split point. Further, where the split point is set near the left end of the key range as shown in FIG. 5B, the horizontally-divided position of the sound color name display section 40 is set near the left end of the key range in conformity with the position of the split point.

Namely, in the instant embodiment, where the horizontally-divided (i.e., left-right-divided) position of the sound color name display section 40 is determined in interlocked relation to the set position of the split point, the user can know approximate left- and right-side key ranges from horizontal displayed widths of the individual sound generation parts in the sound color name display section 40.

Figure 5C:
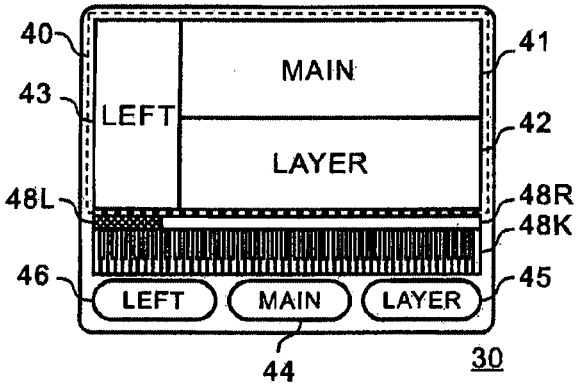

If the horizontally-divided position of the sound color name display section 40 is set in completely-interlocked relation to the set position of the split point as above, the width of the left display area 43 may become so small, depending on the set position of the split point, that necessary information cannot be displayed. Therefore, if the width of the left display area 43 is smaller than a predetermined value, the interlocking between the split point and the horizontally-divided position of the screen may be canceled so that the split point and the horizontally-divided position of the screen are displayed with a positional deviation from each other as shown in FIG. 5C.

Figure 6:
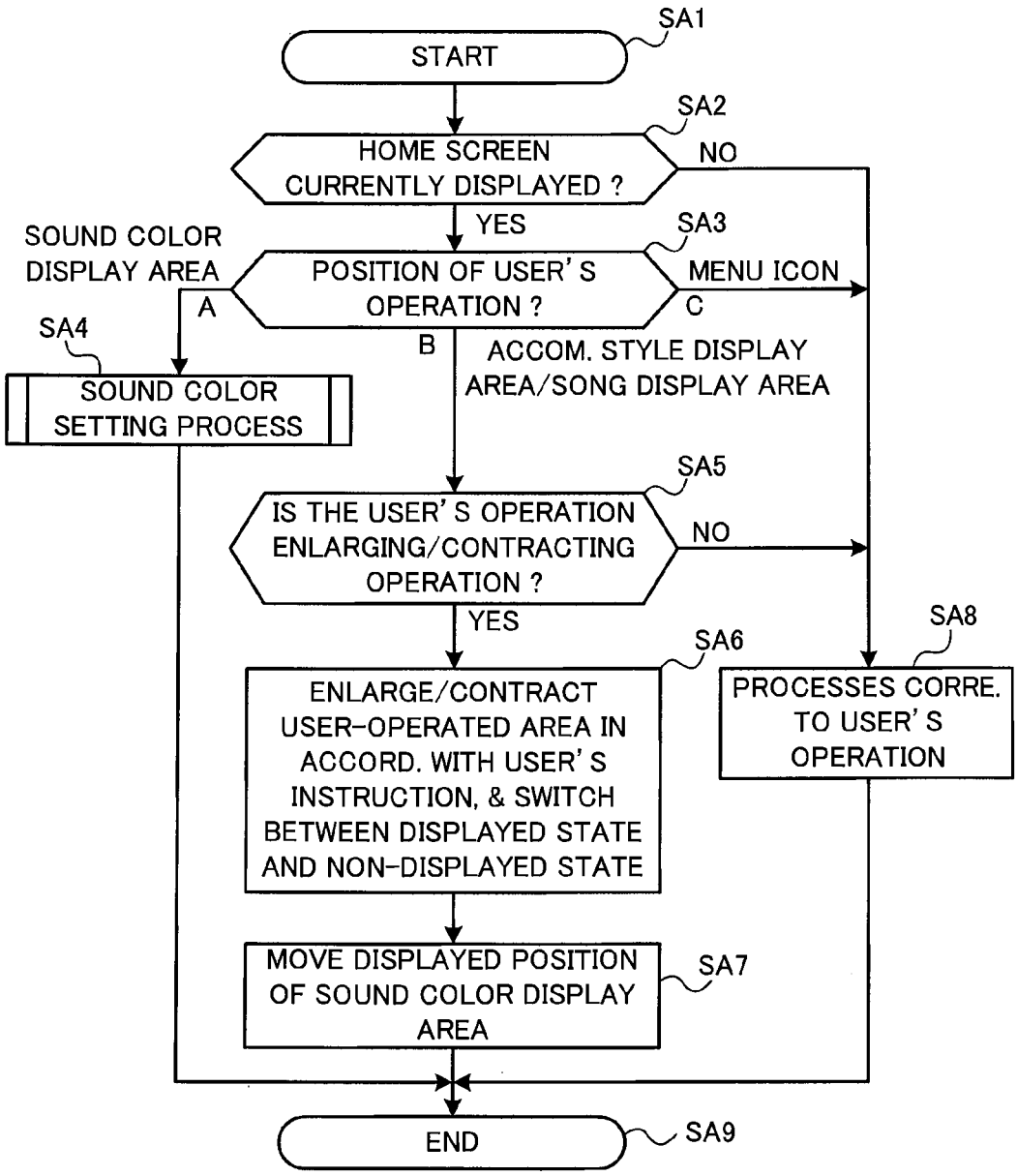
FIG. 6 is a flow chart showing touch panel operation processing (main processing) performed in the instant embodiment of the invention.

FIG. 6 is a flow chart showing touch panel operation processing (main processing) performed in the instant embodiment of the invention. The touch panel operation processing, which is performed by the CPU 9 of FIG. 1, is started up in response to detection of operation (touching operation) performed on the electronic musical instrument 100.

The touch panel operation processing is started up in response to detection of touching operation at step SA1, and then a determination is made, at step SA2, as to whether the home screen shown in FIG. 2 is being currently displayed. If the home screen is being currently displayed (YES determination at step SA2), the processing proceeds to step SA3. If another screen than the home screen is being currently displayed (NO determination at step SA2), operations corresponding to user's operation are performed at step SA8, and then the touch panel operation processing is brought to an end at step SA9. The operations corresponding to user's operation are operations corresponding to all user's setting or selection operation in the electronic musical instrument 100 other than a later-described operation of step SA4 and operations of steps SA5 to SA7.

Figure 7:
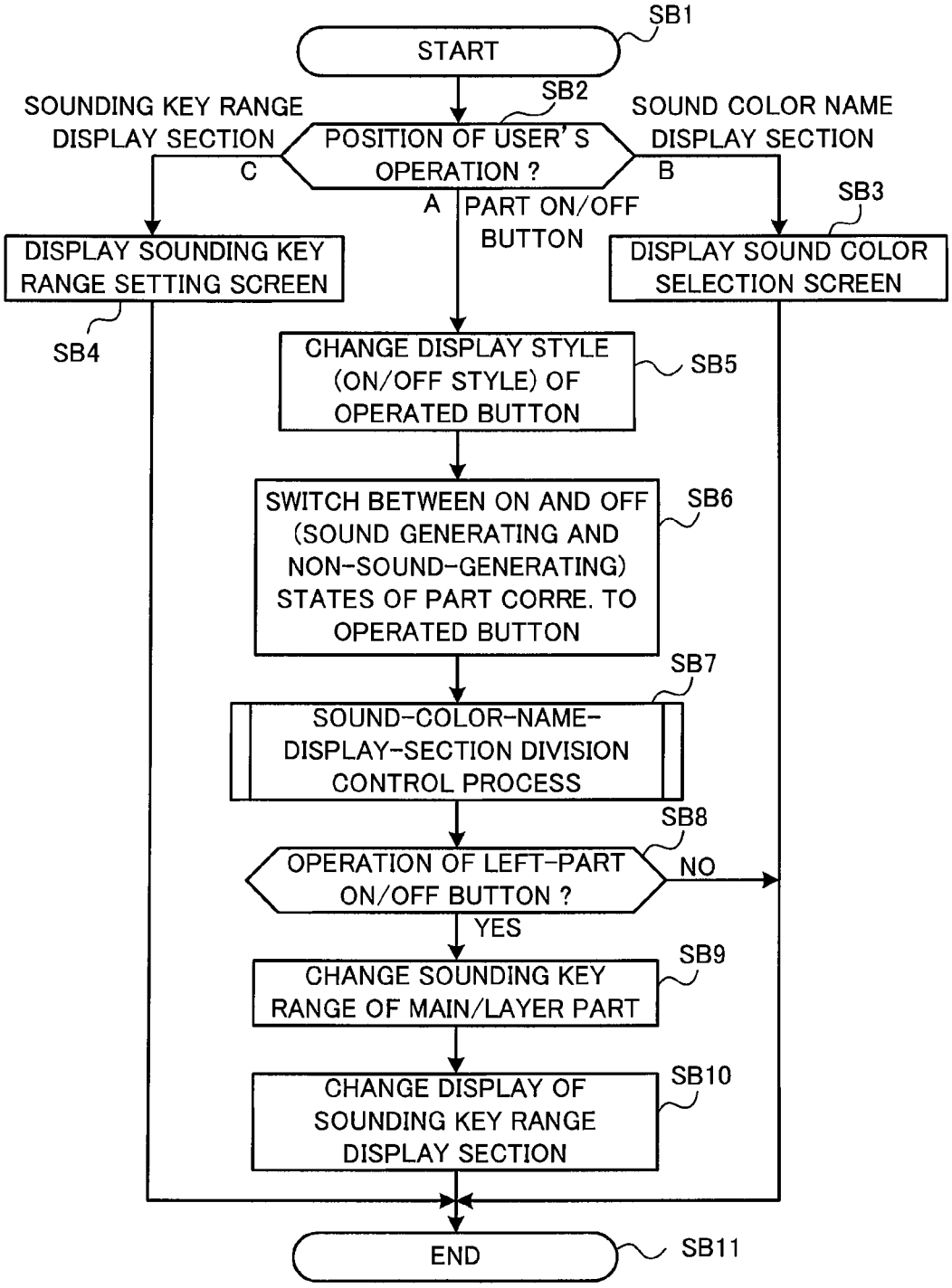
FIG. 7 is a flow chart showing details of a sound color setting process performed in the flow shown in FIG. 6.

At step SA3, a determination is made as to which one of the sound color display area 30, accompaniment style display area 31 or the song display area 32 and the menu icons 34 a position (coordinates) of the detected user's touching operation, having triggered the touch panel operation processing, is within. If the position of the user's touching operation is within the sound color display area 30, the processing goes to step SA4 as indicated by arrow "A", where a sound color setting process shown in FIG. 7 is performed. Upon completion of the sound color setting process of FIG. 7, the touch panel operation processing is brought to an end step SA9. If the position of the user's touching operation is within the accompaniment style display area 31 or the song display area 32, the processing goes to step SA5 as indicated by arrow "B". Further, if the position of the user's touching operation is within any one of the menu icons 34, the processing goes to step SA8 as indicated by arrow "C", where processes corresponding to user's operation are performed. Upon completion of the processes corresponding to user's operation, the touch panel operation processing is brought to an end step SA9.

Operations of steps SA5 to SA7 are for enlarging/contracting the accompaniment style display area 31 or the song display area 32. At step SA5, a determination is made as to whether the user's touching operation, having triggered the touch panel operation processing, is enlarging or contracting operation, i.e. whether the user's touching operation has been performed on the displayed position of the enlarge button 33L or contract button 33S. If answered in the affirmative (YES determination at step SA5), the processing proceeds to step SA6, but, if answered in the negative (NO determination at step SA5), the processing is brought to an end at step SA9.

At step SA6, the user-operated area is enlarged or contracted in accordance with an instruction made by the touching operation, and switching is made between the displayed state and the non-displayed state of another display area. More specifically, if the enlarge button 33L in the accompaniment style display area 31 has been touched by the user, the displayed size of the accompaniment style display area 31 is enlarged, and the song display area 32 is switched to the non-displayed state, as described above with reference to FIG. 3A. If the contract button 33S in the accompaniment style display area 31 has been touched by the user, the displayed size of the accompaniment style display area 31 is contracted (returned to the initial value), and the song display area 32 is displayed again. Conversely, if the enlarge button 33L in the song display area 32 has been touched by the user, the displayed size of the song display area 32 is enlarged, and the accompaniment style display area 31 is switched to the non-displayed state, as described above with reference to FIG. 3B. If the contract button 33S in the enlarged song display area 32 has been touched by the user, the displayed size of the song display area 32 is contracted (returned to the initial value), and the accompaniment style display area 31 is displayed again.

Further, at step SA7, the displayed position of the sound color display area 30 is moved on the basis of the enlargement or contraction at step SA6. More specifically, if the accompaniment style display area 31 has been enlarged, the displayed position of the sound color display area 30 is moved rightward as shown in FIG. 3A. If the song display area 32 has been enlarged, the displayed position of the sound color display area 30 is moved in the left-right direction as shown in FIG. 3B. If both of the accompaniment style display area 31 and the song display area 32 have been contracted, the displayed position of the sound color display area 30 is moved to a central portion of the screen. Then, the touch panel operation processing is brought to an end step SA9.

FIG. 7 is a flow chart showing the sound color setting process performed at step SA4 of FIG. 6. The sound color setting process is started at step SB1, and a determination is made, at step SB2, as to which one of the part ON/OFF buttons (main-part ON/OFF button 44, layer-part ON/OFF button 45 and left-part ON/OFF button 46), sound color name display section 40 and sounding key range display section 48 the position of the user's touching operation (coordinates of the detected touch) having triggered the touch panel operation processing is within. If the position of the user's touching operation is within the part ON/OFF buttons, the process goes to step SB5 as indicated by arrow "A". If the position of the user's touching operation is within the sound color name display section 40, the process goes to step SB3 as indicated by arrow "B", where a sound color selection screen is displayed on the display device 14 (FIG. 1). Following step SB3, the process is brought to an end SB11, after which the touch panel operation processing is brought to an end at step SA9 of FIG. 6. If the position of the user's touching operation is within the sounding key range display section 48, the process goes to step SB4 as indicated by arrow "C", where a sounding key range setting screen is displayed on the display device 14 (FIG. 1). After step SB4, the process is brought to an end at step SB11, after which the touch panel operation processing is brought to an end at step SA9 of FIG. 6.

At step SB5, the part ON/OFF button (main-part ON/OFF button 44, layer-part ON/OFF button 45 or left-part ON/OFF button 46) of which the user's touching operation has been detected is switched from the ON display style to the OFF display style or from the OFF display style to the ON display style.

At step SB6, switching is made between the ON (sound generating) state and the OFF (non-sound-generating) state of the part corresponding to the ON/OFF button (main-part ON/OFF button 44, layer-part ON/OFF button 45 or left-part ON/OFF button 46) of which the user's touching operation has been detected.

Figure 8:
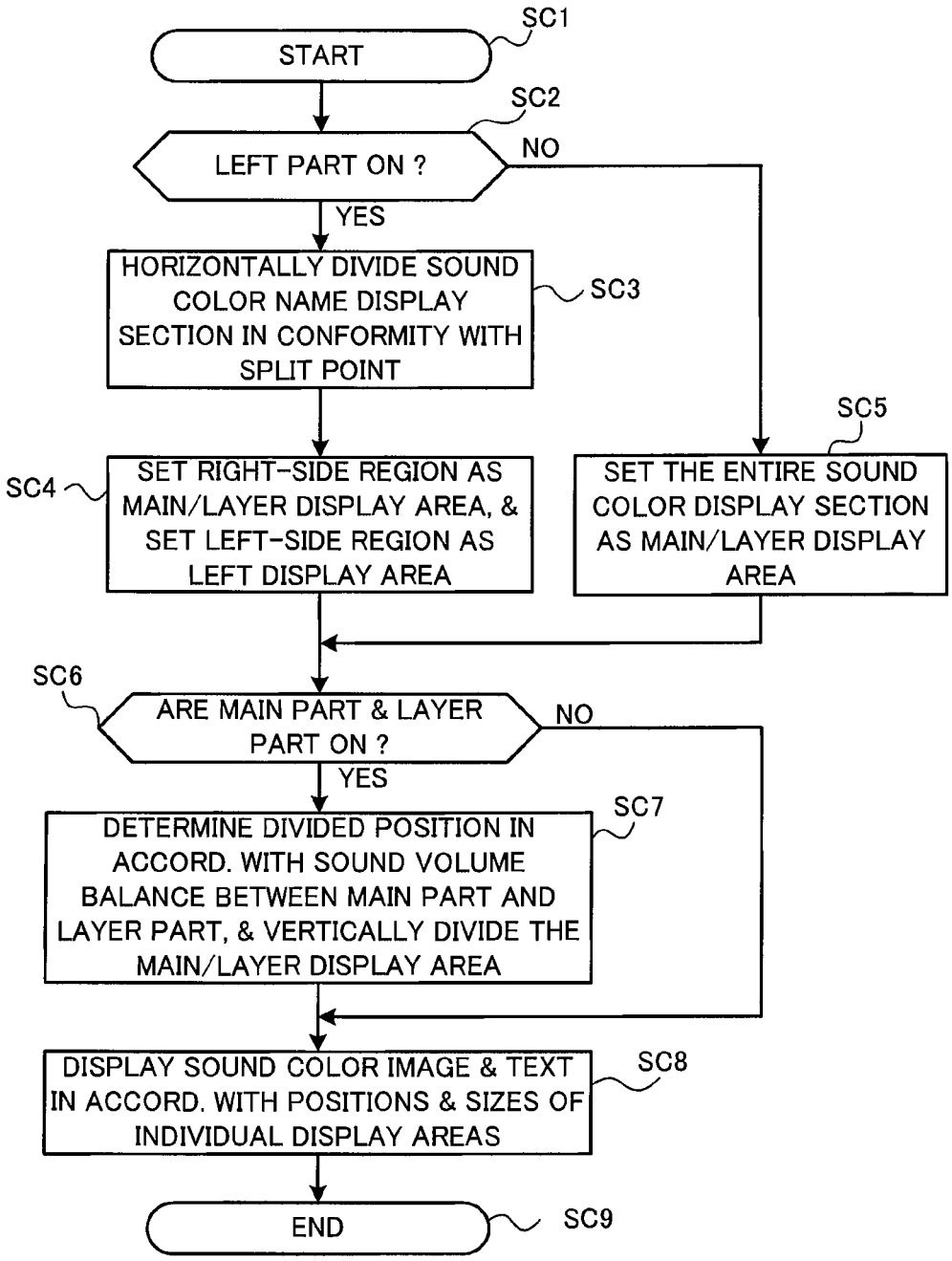
FIG. 8 is a flow chart showing details of a sound-color-name-display-section division control process performed in the flow shown in FIG. 6.

At step SB7, a sound-color-name-display-section division control process shown in FIG. 8 is performed for dividing the display of the sound color name display section 40 in accordance with the respective ON/OFF states (i.e., sound generating/non-sound-generating states) of the sound generation parts. After that, the process proceeds to step SB8, where a determination is made as to whether the user's touching operation, whose has been determined at step SB2 above, is operation of the left-part ON/OFF button 46. If the user's touching operation is operation of the left-part ON/OFF button 46 (YES determination at step SB8), the process goes to step SB9. Otherwise, the sound color setting process is brought to an end at step SB11, after which the touch panel operation processing is brought to an end at step SA9 of FIG. 6.

At step SB9, the sounding key range of the main part and/or the layer part is changed in accordance with the operation of the left-part ON/OFF button 46. If the left-part ON/OFF button 46 has been switched from the ON state to the OFF state, i.e. if the split mode has been from the ON state to the OFF state, the sounding key range of the main part and/or the layer part is changed from the "right-side key range" to the "entire key range". On the other hand, if the left-part ON/OFF button 46 has been switched from the OFF state to the ON state, i.e. if the split mode has been from the OFF state to the ON state, the sounding key range of the main part and/or the layer part is changed from the "entire key range" to the "right-side key range".

At step SB10, the display of the sounding key range display section 48 is changed in accordance with the change of the sounding key range made at step SB9. For example, if the left part has been switched to the ON state, the left-side key range display portion 48L is displayed from the left end of the currently-set sounding key range display section 48 to the split point. If the left part has been switched to the OFF state, the left-side key range display portion 48L is switched to the non-displayed state, and then the sound color setting process is brought to an end at step SB11, after which the touch panel operation processing is brought to an end at step SA9 of FIG. 6.

FIG. 8 is a flow chart showing the sound-color-name-display-section division control process performed at step SB7 of FIG. 7. The sound-color-name-display-section division control process is started at step SC1, and a determination is made, at step SC2, as to whether the left part is currently in the ON (sound generating) state. If the left part is currently in the ON state (YES determination at step SC2), the process goes to step SC3. If, on the other hand, the left part is currently in the OFF state (NO determination at step SC2), the process branches to step SC5, where the entire sound color name display section 40 is set as the main/layer display area. Following step SC5, the process moves on to step SC6.

At step SC3, the sound color name display section 40 is divided into left- and right-side regions in conformity with the currently set split point, as described above with reference to FIG. 5. In the division process, if 30% of the entire key range is set as the left-side key range, left 30% of the sound color name display section 40 is set as the left display area 43. Note that, when the horizontal width of the left display area 43 has become smaller than a predetermined width (minimum necessary width) and thus, for example, necessary information cannot be displayed, the sound color name display section 40 may be divided in view of the minimum necessary width (i.e., in such a manner as to secure at least the minimum necessary width) regardless of the split point.

At step SC4, the right-side region of the left- and right-side regions divided at step SC3 is set as a main/layer display area, and the left-side region is set as the left display area 43. After that, the process moves on to step SC6.

At step SC6, a determination is made as to whether both of the main part and the layer part are currently in the ON (sound generating) state. If both of the main part and the layer part are currently in the ON state (YES determination at step SC6), the process proceeds to step SC7. If only one of the main part and the layer part is currently in the ON state, the process branches to step SC8 as indicated by arrow "NO".

At step SC7, a vertically-divided position of the main/layer display area, which is the right-side region of the sound color name display section 40, is determined in accordance with sound volume balance (i.e., sound ratio) between the main part and the layer, in accordance with which the main/layer display area is vertically divided so that the main display area 41 is set in the upper divided region while the layer display area 42 is set in the lower divided region. Note that, when the height of the main display area 41 or the layer display area 42 has become smaller than a predetermined height (minimum necessary height) and thus, for example, necessary information cannot be displayed, the main/layer display area may be divided in view of the minimum necessary height (i.e., in such a manner as to secure at least the minimum necessary height) regardless of the sound volume balance.

At step SC8, a sound color image, text, etc. of each of the sound generation parts in the ON state are displayed in accordance with positions and sizes of the individual areas. More specifically, if, at that time, only the left part is in the ON state (i.e., if the process has proceeded to step SC8 following the NO determination at step SC6), an indication, such as "No Voice", that the sound generation part displayed in the right-side region is currently in the OFF state is displayed in the main/layer display area. Then, the sound-color-name-display-section division control process is brought to an end at step SC9, after which the processing goes to step SB8 of FIG. 7.

Generally, a construction for implementing the aforementioned operations of steps SC2 to SC7 functions as a division control section adapted to divide the sound color name display section (display area) 40 in order to set the sub display areas 41 to 43 corresponding to one or more sound generation parts selectively set in the sound generating state. Further, a construction for implementing the operation of step SC8 functions as a second display control section adapted to display, in the sub display areas 41 to 43 set by dividing the display section (display area) 40, information related to the corresponding sound generation parts currently set in the sound generating state. Namely, the information related to the sound generation parts currently set in the sound generating state are displayed in the corresponding sub display areas 41 to 43.

By dividing the sound generation part display screen as set forth above, the instant embodiment allows the user to visually recognize not only each sound generation part currently in the ON state but also relationship among the sound generation parts (i.e., whether these sound generation parts are sounded simultaneously, sounded in a left-right divided manner, etc.).

Further, because the displayed size of the sound color display area 30 is not changed even when the accompaniment style display area 31 or the song display area 32 has been enlarged, visibility of information displayed in the sound color display area 30 does not change depending on a state of the home screen. Thus, while the home screen is being displayed, the user can check or ascertain settings etc. of the individual sound generation parts always under the same conditions.

Figure 9:
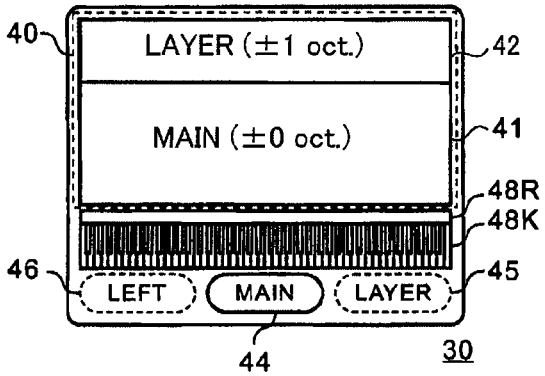
FIG. 9 is a diagram showing another example of screen division of the sound color name display section.

Whereas the preferred embodiment of the invention has been described above in relation to the case where the sound color name display section 40 is vertically divided in such a manner that the main display area 41 is displayed in the upper divided region of the sound color name display section 40 while the layer display area 42 is displayed in the lower divided region of the sound color name display section 40, the present invention is not so limited. For example, one of the main display area 41 and layer display area 42 higher in pitch range than the other may be displayed in the upper divided region with the other of the main display area 41 and layer display area 42 lower in pitch range displayed in the lower divided region in accordance with octave shift settings or transpose settings (i.e., pitch shift settings) of the individual sound generation parts. FIG. 9 shows an example of such a modification, according to which, if the pitch range of the layer part 42 has been set one octave (or two or more octaves) higher than the pitch range of the main display area 41, the layer display area 42 may be positioned in the upper divided region with the main display area 41 positioned in the lower divided region. Further, in this case, on the basis of sound volume balance between the main part and the layer part, the display area of one of the main display area 41 and layer display area 42 having a greater sound volume than the other may be set larger, and the display area of the other of the main display area 41 and layer display area 42 having a smaller sound volume may be set smaller. In FIG. 9, the main part is shown as having a greater sound volume so that the main display area 41 is shown as being displayed in a greater size, as set forth above.

Further, the vertical screen division of the sound color name section 40 may be made such that one of the main and layer display areas 41 and 43 having a higher pitch range than the other is displayed in a greater size than the other and the other of the main and layer display areas 41 and 43 having a lower pitch range is displayed in a smaller size, in accordance with octave shift settings or transpose settings of the individual sound generation parts. Namely, in this case, the arrangement where the main display area 41 is positioned in the upper divided region and the layer display area 42 is positioned in the lower divided region is maintained, but, when the pitch range of the layer part has become higher than that of the main part due to the octave or transpose settings, the layer display area 42 is displayed in a greater size than the main display area 41.

Figure 10:
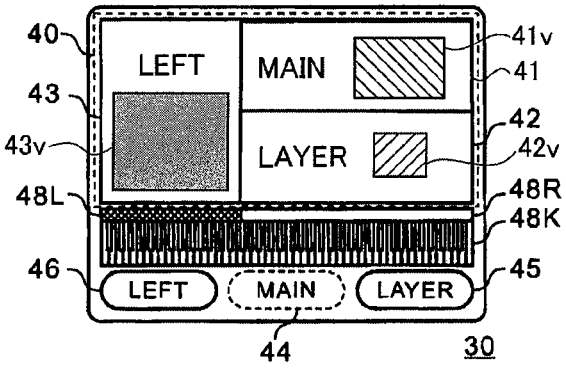
FIG. 10 is diagram showing still another example of screen division of the sound color name display section.

Furthermore, in vertically dividing the sound color name display section 40, the vertically-dividing line may be fixed so that the main display area 41 and the layer display area 42 are fixed in size (area) regardless of the sound volume balance. In this case, as shown in FIG. 10, displayed sizes (areas) of sound color images (icons) 41*v* and 42*v* or the like displayed within the main display area 41 and layer display area 42 may be enlarged or contracted to indicate sound volume balance between the main part and the layer part. Further, in such a case, sound volume balance between the left part and the main and layer parts may also be indicated by enlarging or contracting a displayed size of a sound color image (icon) 43*v* or the like in proportion to sounds of the sound generation parts, so that sound volume balance (ratio) among all of the sound generation parts can be visually recognized. In the illustrated example of FIG. 10, the icon 41*v* is greater in size than the icon 42*v*, which indicates that the sound of the main part is greater than that of the layer part. Further, in the illustrated example of FIG. 10, the icon 43*v* of the left display area 43 is greater than each of the icons 41*v* and 42*v*, which indicates that the sound volume of the left part is currently set greater than each of the sound volumes of the main part and layer part.

Furthermore, the preferred embodiment has been described above as allowing a plurality of sound generation parts to be set only in the right-side region in the split mode. Alternatively, the main and layer parts may be set in the left-side region as well so that a total of four sound generation parts can be set. In such a case, the left-side region may also be displayed in a divided manner in accordance with the vertical (up-down) division scheme described above in relation to the right-side region.

Furthermore, in the split mode, the sounding key range display section 48 may be horizontally divided into three or more key range display portions rather than into two key range display portions. Furthermore, in the layer mode, three or more sound colors rather than two sound colors of the main and layer parts may be simultaneously sounded. In these cases, the screen is divided horizontally and vertically in accordance with the number of the sound generation parts.

Furthermore, whereas the preferred embodiment has been described above on the assumption that the electronic musical instrument 100 is a keyboard musical instrument, the electronic musical instrument 100 may be an electronic percussion instrument having a plurality of pads and the like, in which case sound colors may be displayed in correspondence with positions of the pads.

Note that the embodiment of the present invention need not necessarily limited to the form of electronic musical instruments and may be implemented by a commercially-available computer or the like having installed therein a computer program constructed to perform the processing described above in relation to the embodiments or by an independent hardware apparatus constructed to perform the processing described above in relation to the embodiments. In such a case, computer programs etc. corresponding to the above-described embodiments may be supplied to users in a storage medium, such as a CD-ROM, readable by a computer. Further, if the computer or the like is connected to a communication network, such as a LAN, the Internet or a telephone line, the computer programs, various data etc. may be supplied to users via the communication network.

Finally, it should be appreciated that, whereas the present invention has been described in relation to various embodiments, it is not limited to the above-described embodiments, and various modifications, improvements and combinations thereof, etc. are also possible.

This application is based on, and claims priority to, JP PA 2012-014000 filed on 26 Jan. 2012. The disclosure of the priority application, in its entirety, including the drawings, claims, and the specification thereof, are incorporated herein by reference.

What is claimed is:

1. A processing device for displaying a state of a tone generation apparatus, the tone generation apparatus being configured to be capable of generating tones in correspondence with individual ones of a plurality of sound generation parts and allocating desired sound colors and pitch ranges to the individual sound generation parts, said processing device comprising:

a first display control section adapted to present, on a display device, a display area for displaying information related to the plurality of sound generation parts;

a selection section adapted to selectively set individual ones of the sound generation parts either in a sound generating state or in a non-sound-generating state;

a division control section adapted to divide the display area in order to set sub display areas corresponding to one or more of the sound generation parts having been set in the sound generating state by said selection section; and a second display control section adapted to display the information related to the sound generation parts, having been set in the sound generating state, in corresponding ones of the sub display areas set by the division control section dividing the display area.

2. The processing device as claimed in claim 1, wherein said division control section determines, on the basis of pitch ranges of the sound generation parts having been set in the sound generating state, a position at which the display area is to be divided.

3. The processing device as claimed in claim 1, where said division control section determines a size of each of the sub display areas in accordance with sound volume balance between the one or more sound generation parts having been set in the sound generating state.

4. The processing device as claimed in claim 1, wherein said division control section determines, in accordance with sound volume balance between the one or more sound generation parts having been set in the sound generating state, sizes of images to be displayed in individual ones of the sub display areas.

5. The processing device as claimed in claim 1, wherein said division control section controls a position of each of the sub display areas corresponding to the sound generation parts in accordance with a pitch shift setting of the sound generation part.

6. The processing device as claimed in claim 1, wherein the first display control section is adapted to present the display area on the display device of an electronic musical instrument.

7. A method for displaying a state of a tone generation apparatus, the tone generation apparatus being configured to be capable of generating tones in correspondence with individual ones of a plurality of sound generation parts and allocating desired sound colors and pitch ranges to the individual sound generation parts, said method comprising:

a step of presenting, on a display device, a display area for displaying information related to the plurality of sound generation parts;

a step of selectively setting individual ones of the sound generation parts either in a sound generating state or in a non-sound-generating state;

a step of dividing the display area in order to set sub display areas corresponding to one or more of the sound generation parts having been set in the sound generating state; and a step of displaying the information related to the sound generation parts, having been set in the sound generating state, in corresponding ones of the sub display areas set by dividing the display area.

8. A non-transitory computer-readable storage medium containing a group of instructions executable by a computer to performing a method for displaying a state of a tone generation apparatus, the tone generation apparatus being configured to be capable of generating tones in correspondence with individual ones of a plurality of sound generation parts and allocating desired sound colors and pitch ranges to the individual sound generation parts, said method comprising:

a step of presenting, on a display device, a display area for displaying information related to the plurality of sound generation parts;

a step of selectively setting individual ones of the sound generation parts either in a sound generating state or in a non-sound-generating state;

a step of dividing the display area in order to set sub display areas corresponding to one or more of the sound generation parts having been set in the sound generating state; and a step of displaying the information related to the sound generation parts, having been set in the sound generating state, in corresponding ones of the sub display areas set by dividing the display area.

* * * * *